United States Patent [19]

Cauley

[11] 4,154,275

[45] May 15, 1979

[54] HAND BAG

[76] Inventor: Mary L. Cauley, 356 Coleman Dr., Monroeville, Pa. 15146

[21] Appl. No.: 889,639

[22] Filed: Mar. 24, 1978

[51] Int. Cl.[2] ..... A45C 15/08

[52] U.S. Cl. ..... 150/35; 150/34

[58] Field of Search ..... 150/28 R, 34, 35, 29, 150/30

[56] References Cited

U.S. PATENT DOCUMENTS

| | | | |
|---|---|---|---|
| 508,893 | 11/1893 | Margesson | 150/28 R |
| 1,206,195 | 11/1916 | Beline | 150/30 |
| 1,425,217 | 8/1922 | Regulski | 150/28 R |
| 2,055,852 | 9/1936 | Resnick | 150/34 |
| 2,413,465 | 12/1946 | Ohlsen | 150/34 |
| 2,694,428 | 11/1954 | Fisher | 150/29 |
| 2,851,076 | 9/1958 | Stakofsky | 150/28 R |

FOREIGN PATENT DOCUMENTS

| | | | |
|---|---|---|---|
| 1024871 | 1/1953 | France | 150/34 |

*Primary Examiner*—Donald F. Norton
*Attorney, Agent, or Firm*—Hymen Diamond

[57] ABSTRACT

A hand bag including a pocket book and a change purse in which the change purse is connected to the pocket book by a chain in which a watch is interposed. The chain is connected at one end to a metal frame extending about the rim of one of the pivotal sides or flaps of the opening into the main pocket of the pocket book and at the other end to the metal frame extending about one of the pivotal flaps of the opening of the pocket in the change purse. The watch is visible with the change purse in or out of the pocket.

5 Claims, 5 Drawing Figures

FIG. 1
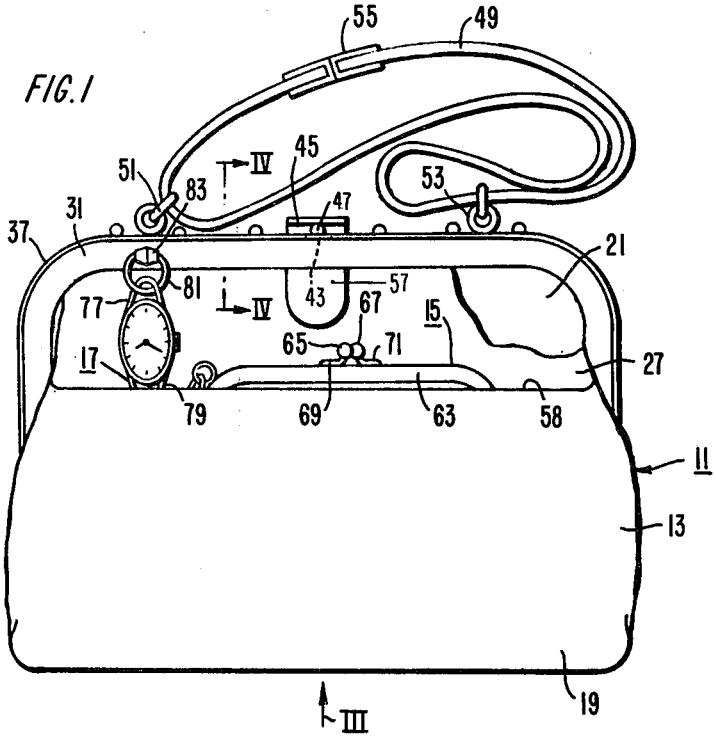
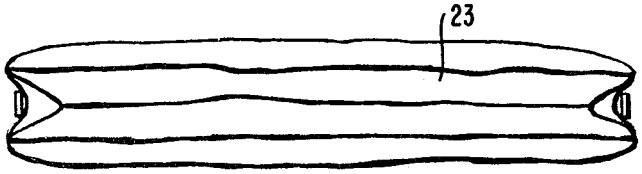
FIG. 3
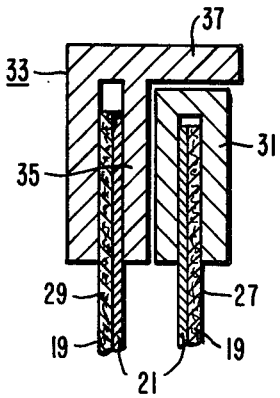
FIG. 4

HAND BAG

BACKGROUND OF THE INVENTION

This invention relates to hand bags and has particular relationship to hand bags which include a change purse in addition to the pocket book. In accordance with the teachings of the prior art the change purse is physically separated from the pocket book. When not in use, it is usually in a side pocket of the pocket book. In the use of hand bags of this type the owner may at times forget to replace the change purse when it is removed from the pocket book.

It is an object of this invention to overcome this drawback and to provide a hand bag whose change purse shall not be separable from the pocket book.

SUMMARY OF THE INVENTION

According to this invention, a hand bag is provided in which the change purse is connected by a flexible-linear member to the pocket book. However, in accordance with an aspect of this invention, this connection performs a double purpose. Timing means is interposed in the flexible-linear member and thus the utility of the hand bag is improved. Specifically, the flexible-linear member is a chain connected at one end near an end of the metal frame extending about a flap which defines the main pocket of the pocket book and at the other end near an end of the metal frame extending about a flap which defines the opening in the change purse.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which:

FIG. 1 is a view in side elevation of a hand bag in accordance with this invention with the change purse in the side pocket of the pocket book;

FIG. 3 is a view in end elevation of the bottom of the hand bag of FIG. 1 taken in direction of the arrow III of FIG. 1;

FIG. 4 is a fragmental view in section taken along line IV—IV of FIG. 1; and

DETAILED DESCRIPTION OF EMBODIMENT

Figure 2:
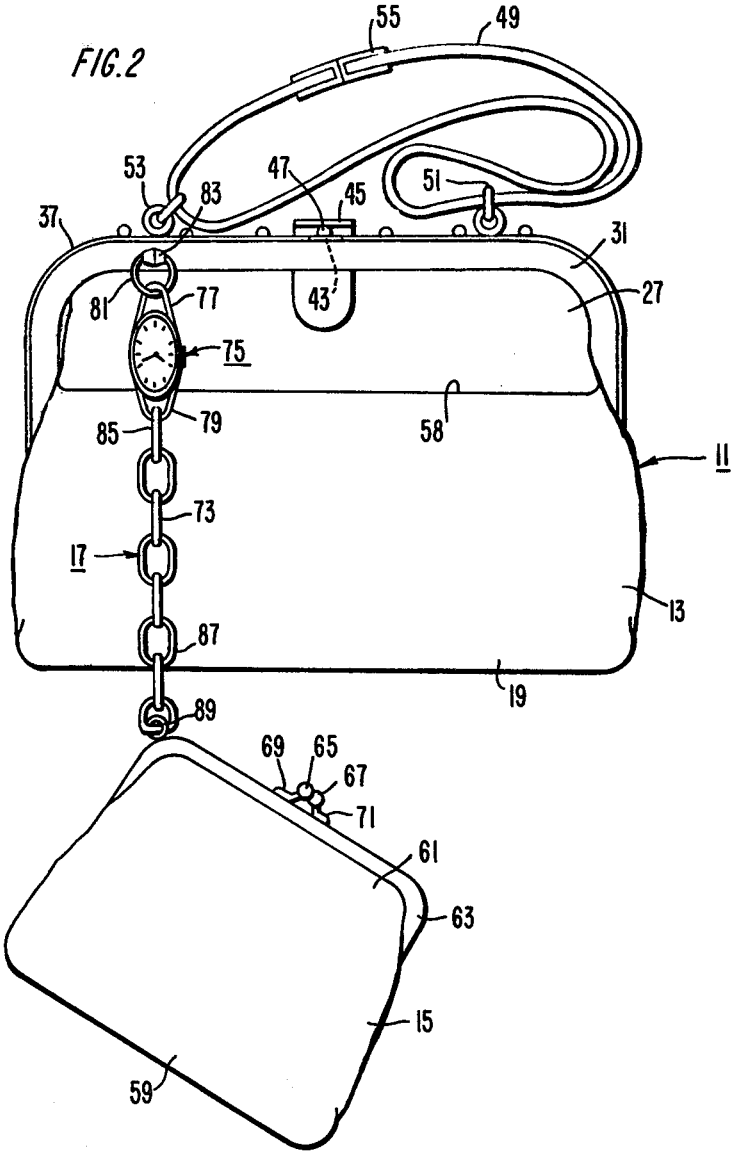
FIG. 2 is a view in side elevation similar to FIG. 1, but with the change purse removed from the side pocket.

A hand bag 11, n accordance with this invention, is shown in FIGS. 1, 2, 3. This hand bag 11 includes a pocket book 13, a change purse 15 and a flexible-linear member 17 interconnecting the pocket book 13 and change purse 15. The pocket book 13 includes a body 19 of leather or like material. The body 19 has a lining 21 of cloth or the like in the inside. The body 19 is of generally rectangular form with reentrant pleats 23 along the sides and bottom. At the top the body 19 has an opening 25 to the main pocket having opposite sides or flaps 27 and 29 (FIG. 4) extending from the pleats 23.

Figure 5:
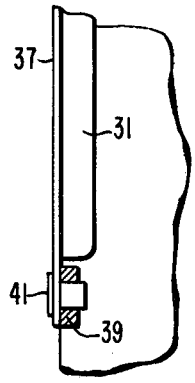
FIG. 5 is a fragmental view in side elevation showing the pivoting mechanism for the flaps of the pocket book of the hand bag shown in FIG. 1.

A metal frame 31 extends along the outer rim of flap 27 on one side. This frame 31 is of U-transverse section and grips or clamps the rim of the flap 27. A frame 33 extends along the outer rim of flap 29. This frame 33 has opposite sides 35 which grip the rim of the flap 29. A lip 37 extends from the sides 35 above the flap 29. With the flaps 27 and 29 closed, the frame 31 seats in the corner between the inner side 35 and the lip 37. At the lower end on both sides of the frame 31 a tab 39 extends from the web of the U. This tab 39 is juxtaposed, on each end, to the corresponding end of the lip 37. On each side of the pocket book the tabs 39 are held together by a rivet 41 (FIG. 5). The frame 31 and the flap 27 which it grips are pivotal in this pin 41.

Centrally on top the lip 37 has a groove 43. A bar 45 is resiliently pivotally supported on the end of the lip 37 and extends over the groove 43. A pin 47 extends centrally from the web of the frame 31. The pin 47 extends above the lower end of the bar 45. When the pocket is closed, the frame 31 and the flap 27 are moved towards the frame 33, the pin 47 raises the bar 45 and is latched under it.

The pocket book 13 is provided with a strap 49. The strap 49 is of rectangular transverse section and is connected to the pocket book 13 by rectangular loops 51 of metal which extend through rings 53 secured, for example by welding, symmetrically to the lip 37. The ends of the strap 49 are tipped by metallic U-section members 55 which are secured together. The flap 27 is provided with a central tab 57 for manipulating this flap. The pocket book has, in addition to the main pocket, a side pocket 58 in which the change purse is held.

The change purse 15 has a body 59 of leather or the like, lined on the inside with cloth or the like. The body 59 has reentrant grooves (not shown) on the side. Flaps 61 for opening or closing the purse 15 extend from the grooves. Each flap 61 has a frame 63 of generally U-transverse cross section which grips the upper rim of the flap. Buttons 65 and 67 extend from tabs 69 and 71 secured respectively to a web of each frame 63. The buttons 65 and 67 extend on each side of the center of the frames 63 and overlap so that they serve as a latch for closing the purse.

The flexible-linear member 17 is a chain 73. A watch 75 is interposed in this chain 73. The end link of the chain 73 is in separate parts 77 and 79 of hair-pin shape. The ends of the part 77 are secured, by welding for example, to one end of the watch 75 and the ends of the other part 79 are likewise secured to the opposite end of the watch 75. The part 77 is linked by a ring 81 supported by a ring 83 secured, by welding for example, near one end of the frame 31. The other part 79 is linked to an end link 85 of the chain 73. The other end link 87 of the chain 73 is linked to a ring 89 secured by welding near one end of one of the frames 63 of the purse 15. The change purse 15 is thus supported so that when it is inserted in the side pocket 58, the face of the watch 75 is visible to the user of the hand bag.

While a preferred embodiment of this invention has been disclosed herein, many modifications thereof are feasible. This invention is not to be restricted except insofar as is necessitated by the spirit of the prior art.

I claim:

1. A hand bag including a pocket book and a change purse and a flexible-linear member interconnecting said pocket book and said change purse, said linear member having timing means interposed therein.

2. The hand bag of claim 1 wherein the pocket book is bounded by a first frame and the change purse is bounded by a second frame wherein a first ring is secured to said first frame and a second ring is secured to said second frame and said flexible-linear member is suspended between said first and second rings.

3. The hand bag of claim 2 wherein the first ring is secured to the first frame near one end of the pocket book and the second ring is secured to the second frame near one end of said change purse.

4. The hand bag of claim 1 wherein the linear member is a chain, having two sections, each section terminating at the end adjacent the other section in a generally U-shaped link, the timing means being secured at one end to the legs of said link terminating one section and at the other end to the legs of said link terminating the other section, one of the sections being connected to the pocket book and the other to the change purse.

5. A hand bag including a pocket book and a change purse, said pocket book having a pocket in the lower portion thereof within which said change purse is normally removeably contained, the opening in said pocket being displaced from the upper boundary of said pocket book, a flexible linear member inter-connecting said pocket book and said change purse, said linear member being formed of a first section connected to said boundary and a second section connected to said change purse, and timing means interposed between said sections, said first section being short compared to said second section so that the face of said timing means is visible when said timing means is in said pocket.

* * * * *